US007603812B2

(12) United States Patent
Yokomori

(10) Patent No.: US 7,603,812 B2
(45) Date of Patent: Oct. 20, 2009

(54) POWERED DEVICE FOR VEHICLE SLIDING DOOR

(75) Inventor: Kazuhito Yokomori, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 650 days.

(21) Appl. No.: 10/490,264

(22) PCT Filed: Sep. 24, 2002

(86) PCT No.: PCT/JP02/09753

§ 371 (c)(1),
(2), (4) Date: Feb. 25, 2005

(87) PCT Pub. No.: WO03/027426

PCT Pub. Date: Apr. 3, 2003

(65) Prior Publication Data

US 2005/0150167 A1 Jul. 14, 2005

(30) Foreign Application Priority Data

Sep. 21, 2001 (JP) ..... 2001-288570

(51) Int. Cl.
*E05F 11/00* (2006.01)

(52) U.S. Cl. ..... 49/360; 49/324

(58) Field of Classification Search ..... 49/360, 49/352, 324

See application file for complete search history.

(56) References Cited

U.S. PATENT DOCUMENTS 5,105,131 A 4/1992 Schap
5,323,570 A * 6/1994 Kuhlman et al. ..... 49/360
5,564,231 A * 10/1996 Tajima et al. ..... 49/352
5,755,059 A 5/1998 Schap
5,913,563 A 6/1999 Watanabe et al.
6,009,671 A 1/2000 Sasaki et al.
6,108,976 A * 8/2000 Kato et al. ..... 49/360
6,125,586 A 10/2000 Buscher
6,904,717 B2 * 6/2005 Clark et al. ..... 49/28
2002/0088180 A1 7/2002 Yokomori

FOREIGN PATENT DOCUMENTS

JP 9-273358 10/1997
JP 10-131612 5/1998
JP 11/91355 4/1999

* cited by examiner

*Primary Examiner*—Gregory J. Strimbu
(74) *Attorney, Agent, or Firm*—Browdy and Neimark, P.L.L.C.

(57) ABSTRACT

A powered sliding device includes a wire drum (16) connected to a vehicle sliding door (11) through wire cables (18, 19), a motor (14) for rotating the wire drum, a clutch mechanism (25) provided between the motor and the wire drum, a rotational member (85) rotated integrally with the wire drum, detection apparatus (86) for detecting the rotation of the rotational member, and a housing (74). The housing includes a first space (76) accommodating the wire drum and communicating with the outside of the housing through the wire cables and a second space accommodating the rotational member and the detection apparatus, and a housing body (73) provided between the first space and the second space which separates the first space and the second space.

3 Claims, 10 Drawing Sheets

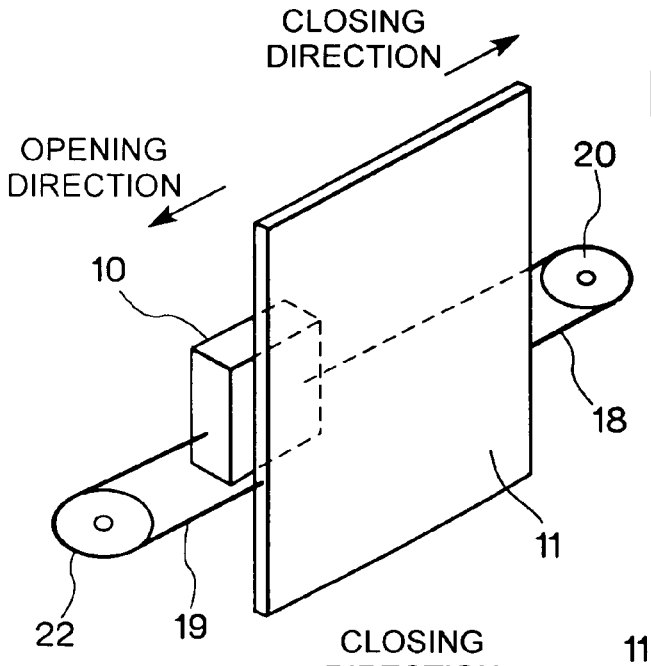
FIG. 1
FIG. 2
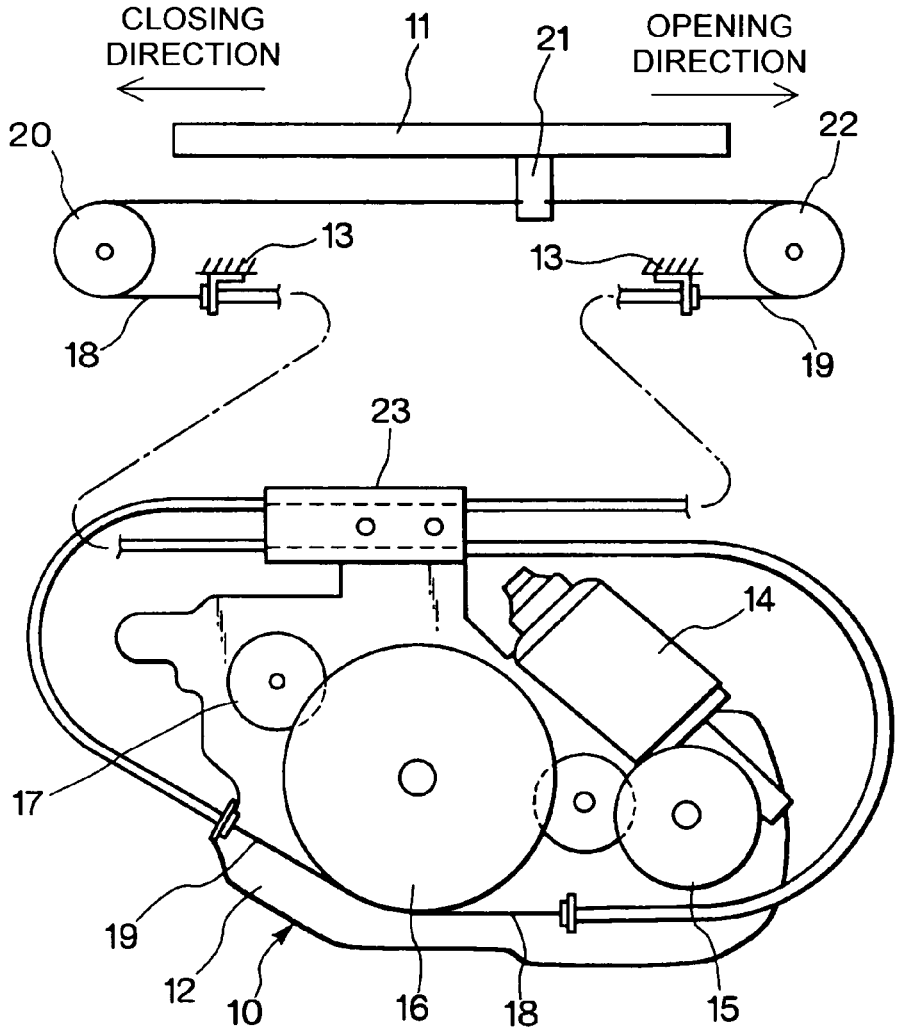

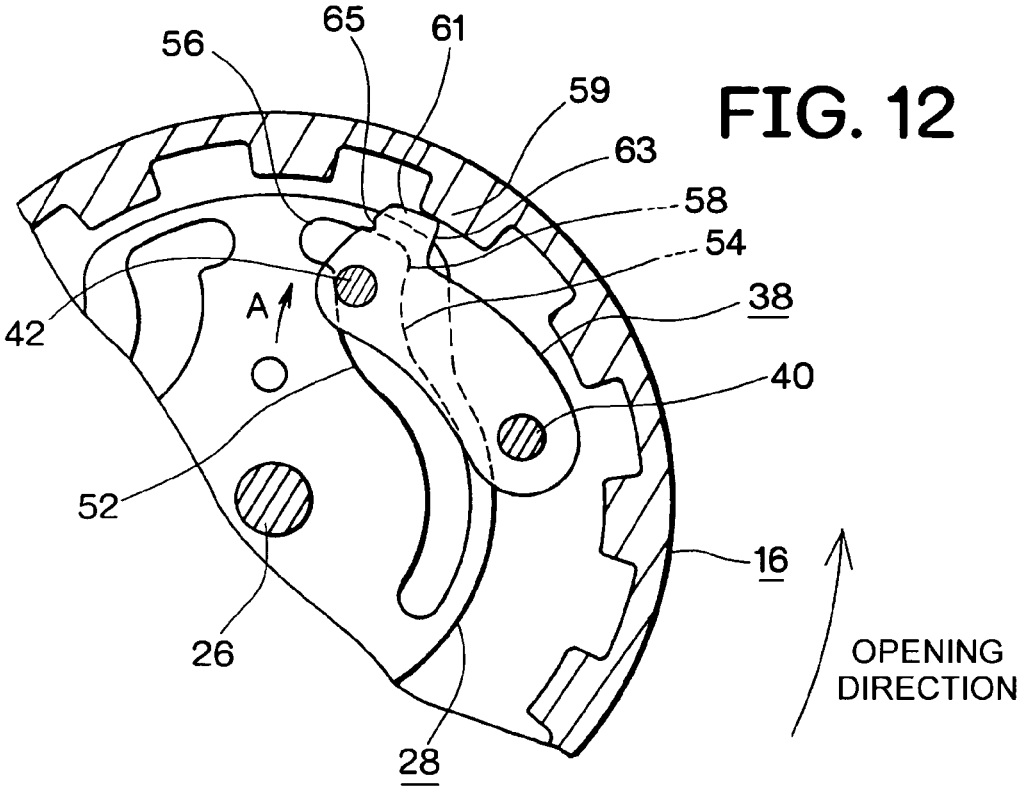
FIG. 12
FIG. 13
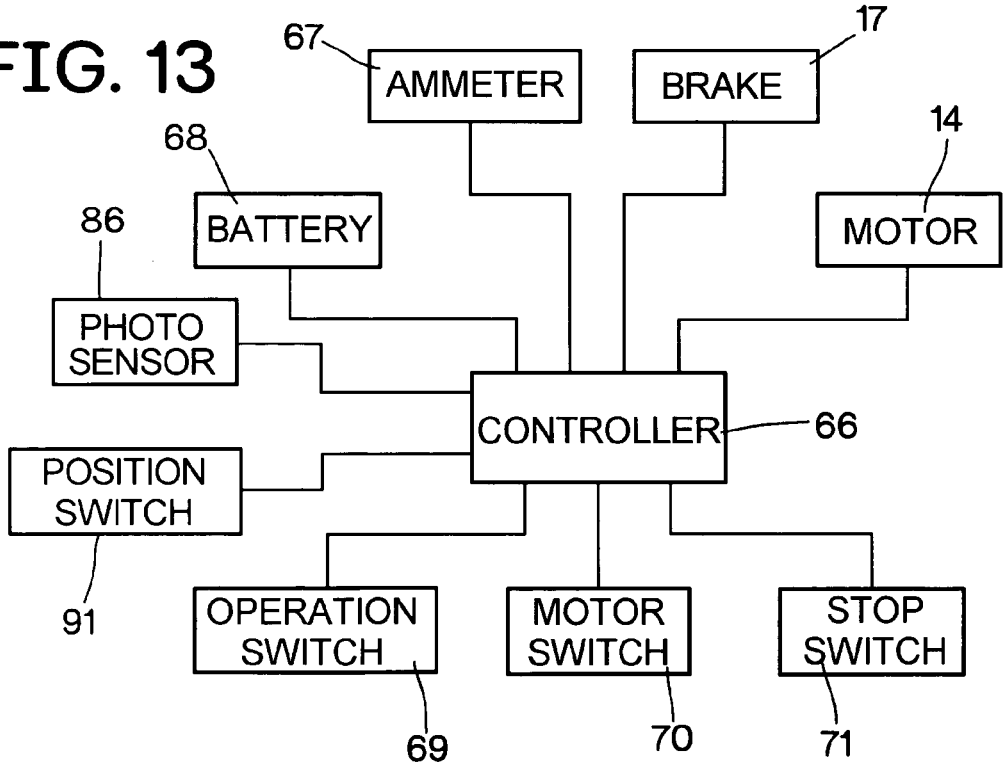

POWERED DEVICE FOR VEHICLE SLIDING DOOR

TECHNICAL FIELD

The present invention relates to a powered sliding device for use of a vehicle sliding door, and in particular, it relates to a housing accommodating movable parts and electrical equipment of the sliding device.

BACKGROUND ART

A conventional typical powered sliding device comprises a wire drum connected to a sliding door through a wire cable, a motor for rotating the wire drum, a clutch mechanism provided between the wire drum and the motor, and a sensor for detecting a rotation of the wire drum. The signal from the sensor is used for finding a moving velocity of the sliding door and the like.

The sensor and the wire drum are provided in the same space within a housing of the sliding device. This is because the sensor needs to directly detect the rotation of the wire drum. If the sensor is designed so as to detect the rotation of the motor, the sensor is unable to detect the movement of the sliding door when the clutch mechanism is in an uncoupled state.

The housing is designed in such a way that dust and rainwater do not enter the interior as little as possible. However, the inside of the housing is communicated with the outside of the housing through the wire cable which connects the sliding door and the wire drum. When a wire cable is wound up by the rotation of the wire drum, the dust and rainwater adhered on the wire cable easily enter into the inside of the housing causing damage to the electrical equipment such as the sensor and the like.

DISCLOSURE OF THE INVENTION

Therefore, the object of the present invention is to provide an improved housing of the powered sliding device for use of the vehicle sliding door.

BRIEF DESCRIPTION OF THE DRAWINGS

FIG. 1 is a perspective view showing a relation between a powered sliding device according to the present invention and a sliding door;

FIG. 2 is a development view of the sliding device and the sliding door;

FIG. 12 is a longitudinal sectional view showing a state where the wire drum is further rotated in the opening direction from the state shown in FIG. 11 to make the clutch mechanism into the uncoupled state;

FIG. 13 is a diagram of a block circuit for performing control operations of the present invention;

BEST MODE FOR CARRYING OUT THE INVENTION

Figure 3:
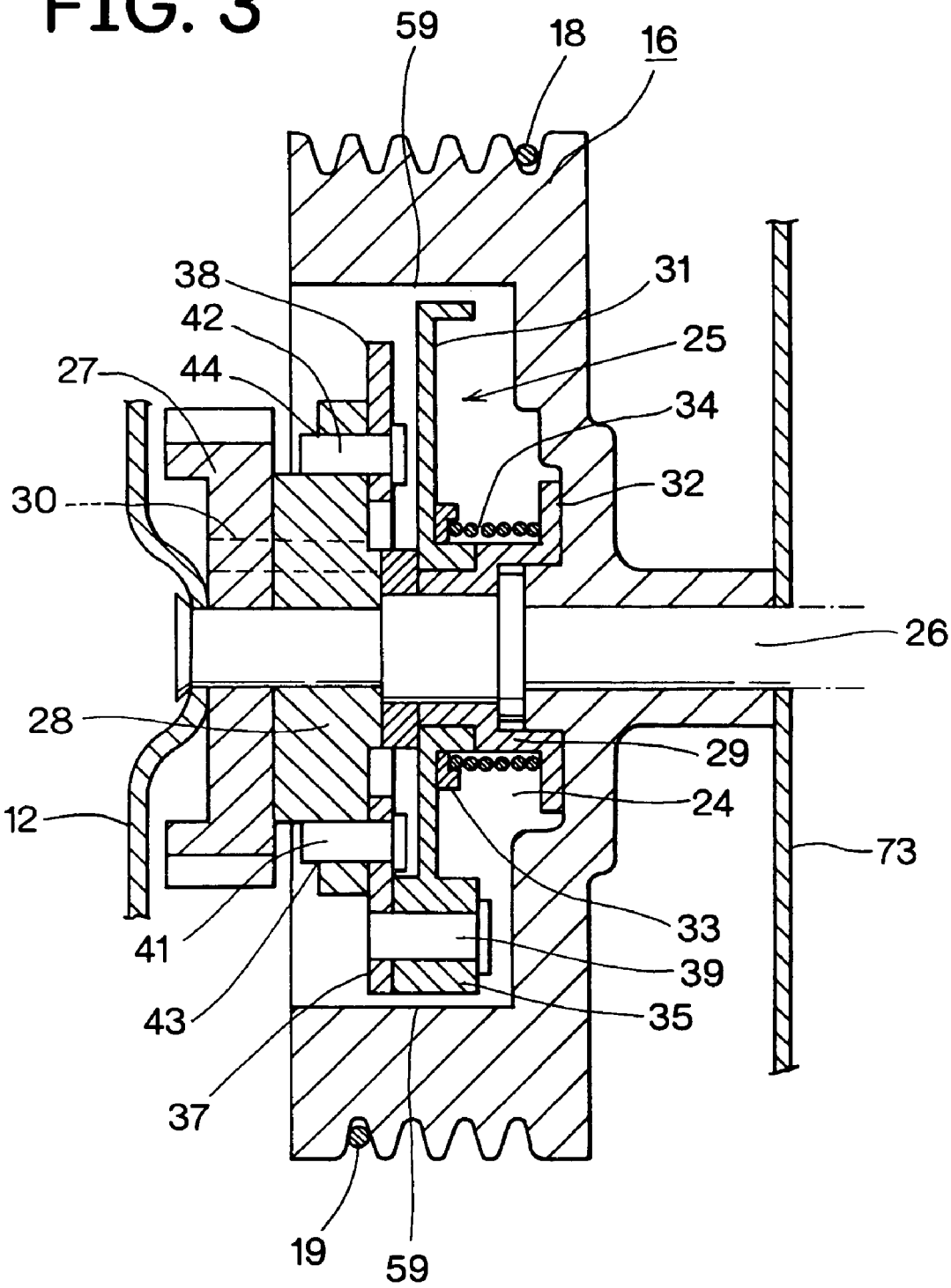
FIG. 3 is a longitudinal sectional side view of the sliding device.

One embodiment of the present invention will be described with reference to the drawings. A mechanical constitution of a powered sliding device 10 of the present invention as shown in FIGS. 1 to 12 is the same as the mechanical structure previously proposed by the present applicant (refer Japanese Patent Application Laid-Open No. 2002-201858, U.S. 2002/0088180A1, GB2371333A, DE10164363A1).

FIG. 1 shows a schematic relation between a powered sliding device 10 and a vehicle sliding door 11 which is slidable in a closing direction and an opening direction by the powered sliding device 10. FIG. 2 shows a relation that the both of them are developed. The powered sliding device 10 has a motor 14, a reduction mechanism 15, a wire drum 16 and an auxiliary brake 17, and they are mounted on a base plate 12 fixed on a vehicle body 13. The auxiliary brake 17 has an electric control part such as a solenoid or the like. The auxiliary brake 17 applies the rotation resistance to the wire drum 16 when actuated.

One end sides of two wire cables 18 and 19 are coupled to the wire drum 16. Other end side of the first cable 18 is coupled to a bracket 21 of the sliding door 11 via a front side pulley 20 which is pivotally attached to the vehicle body 13. Similarly, other end side of the second cable 19 is coupled to the bracket 21 via a rear side pulley 22 pivotally attached to the vehicle body 13. When the wire drum 16 is rotated clockwise, the first cable is rewound as well as the second wire cable 19 is derived, so that the sliding door 11 is slid in the closing direction. When the wire drum 16 is rotated counterclockwise, the sliding door 11 is slid in the opening direction.

A tension case 23 with tension springs (not shown) is fixed on the base plate 12 by screws, and a predetermined tension is applied to each of the cables 18 and 19.

As shown in FIG. 3, a clutch mechanism 25 is substantially stored in a relatively large inside space 24 of the wire drum 16. The clutch mechanism 25 has a first coupled state for transmitting the closing rotation of the motor 14 to the wire drum 16, a second coupled state for transmitting the opening rotation of the motor 14 to the wire drum 16, a first brake state for transmitting the closing rotation of the wire drum 16 to the motor 14, a second brake state for transmitting the opening rotation of the wire drum 16 to the motor 14 and an uncoupled state for transmitting neither the closing rotation nor the opening rotation of the wire drum 16 to the motor 14.

Figure 4:
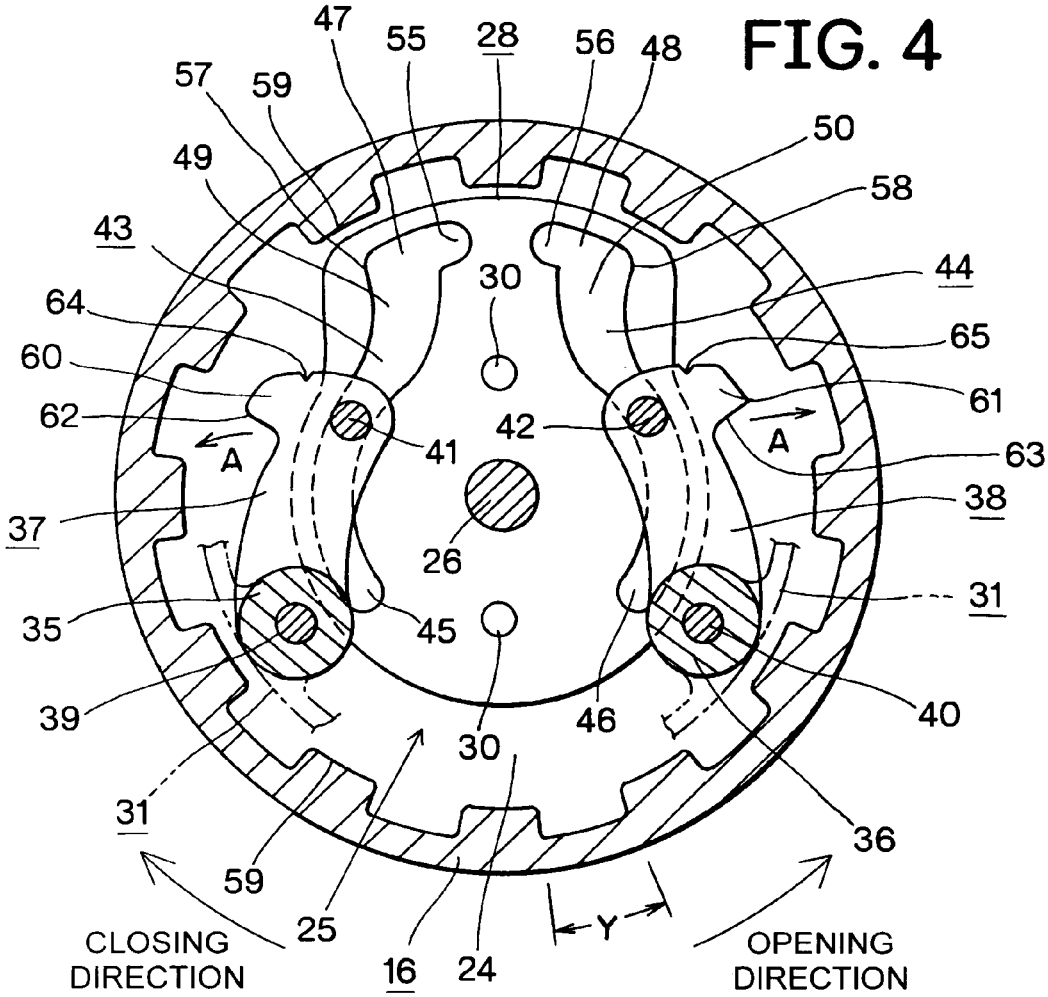
FIG. 4 is a longitudinal sectional view showing an uncoupled state of a clutch mechanism of the sliding device.

A drum shaft 26 of the wire drum 16 is rotatably attached with an output gear 27, a motor plate 28 and a sleeve 29, respectively. The output gear 27 is coupled to the motor 14 via the reduction mechanism 15. The output gear 27 and the motor plate 28 are integrally coupled by coupling pins 30 as one piece. Hence, in FIG. 4 and the figures similar to FIG. 4 is shown only the motor plate 28 as a final member of the motor 14 side for simplifying the figures. A disk-like clutch plate 31 is rotatably attached to a periphery of the sleeve 29. A friction spring 34 is provided between the clutch plate 31 and a flange 32 of the sleeve 29 via a tray 33. The spring 34 applies a comparatively low rotational resistance to the clutch plate 31.

The clutch plate 31 has, on outer edge portions thereof, boss portions 35, 36 shown by the cross section in FIG. 4 to which clutch arms 37, 38 are rotatably attached by arm shafts 39, 40, respectively. The clutch arms 37, 38 respectively have, on the tip side thereof, slide pins 41, 42 which are slidably engaged with guide slots 43, 44 formed in the motor plate 28, respectively.

Figure 5:
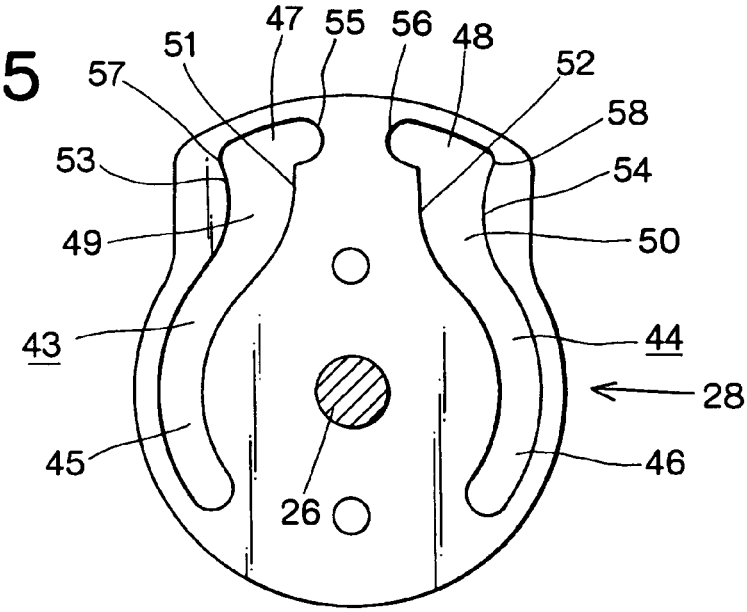
FIG. 5 is a front view of a motor plate of the clutch mechanism.

The guide slots 43, 44 are bilaterally symmetrical as shown in FIG. 5. The guide slots 43, 44 respectively comprise circular arc inner slots 45, 46 around the drum shaft 26, circular arc outer slots 47, 48 around the drum shaft 26, and communication slots 49, 50 connecting the inner slots 45, 46 and the outer slots 47, 48. Each of the gaps between inside walls 51, 52 and outside walls 53, 54 of the communication slots 49, 50 is expanded as it is apart from the drum shaft 26. Semicircular engaging portions 55, 56 are respectively formed at one sides of both outer slots 47, 48. The other sides of the outer slots 47, 48 are respectively formed into contact faces 57, 58 which are flush with the outside walls 53, 54 with no difference in level.

Figure 6:
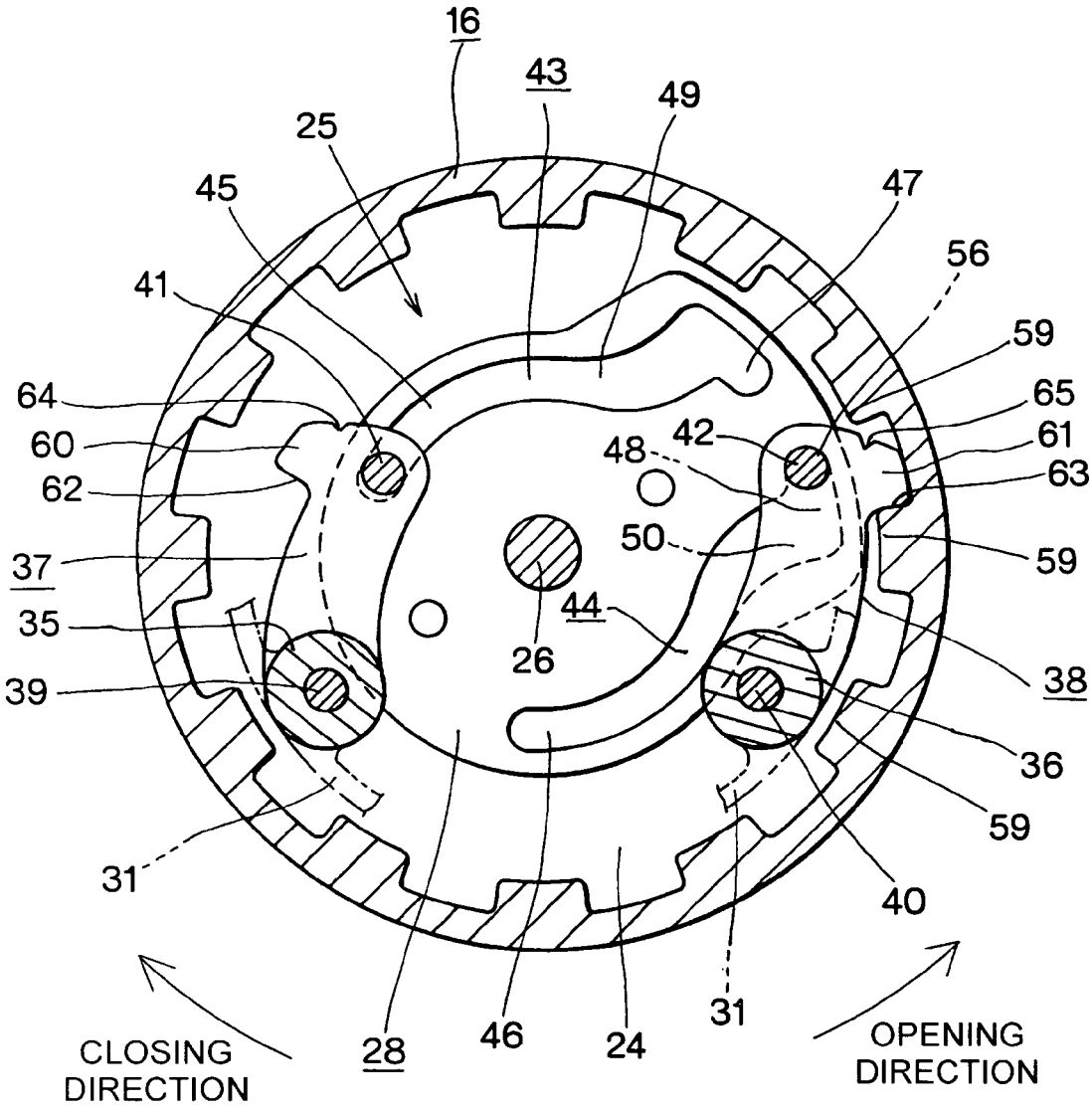
FIG. 6 is a longitudinal sectional view showing a first coupled state of the clutch mechanism.
Figure 7:
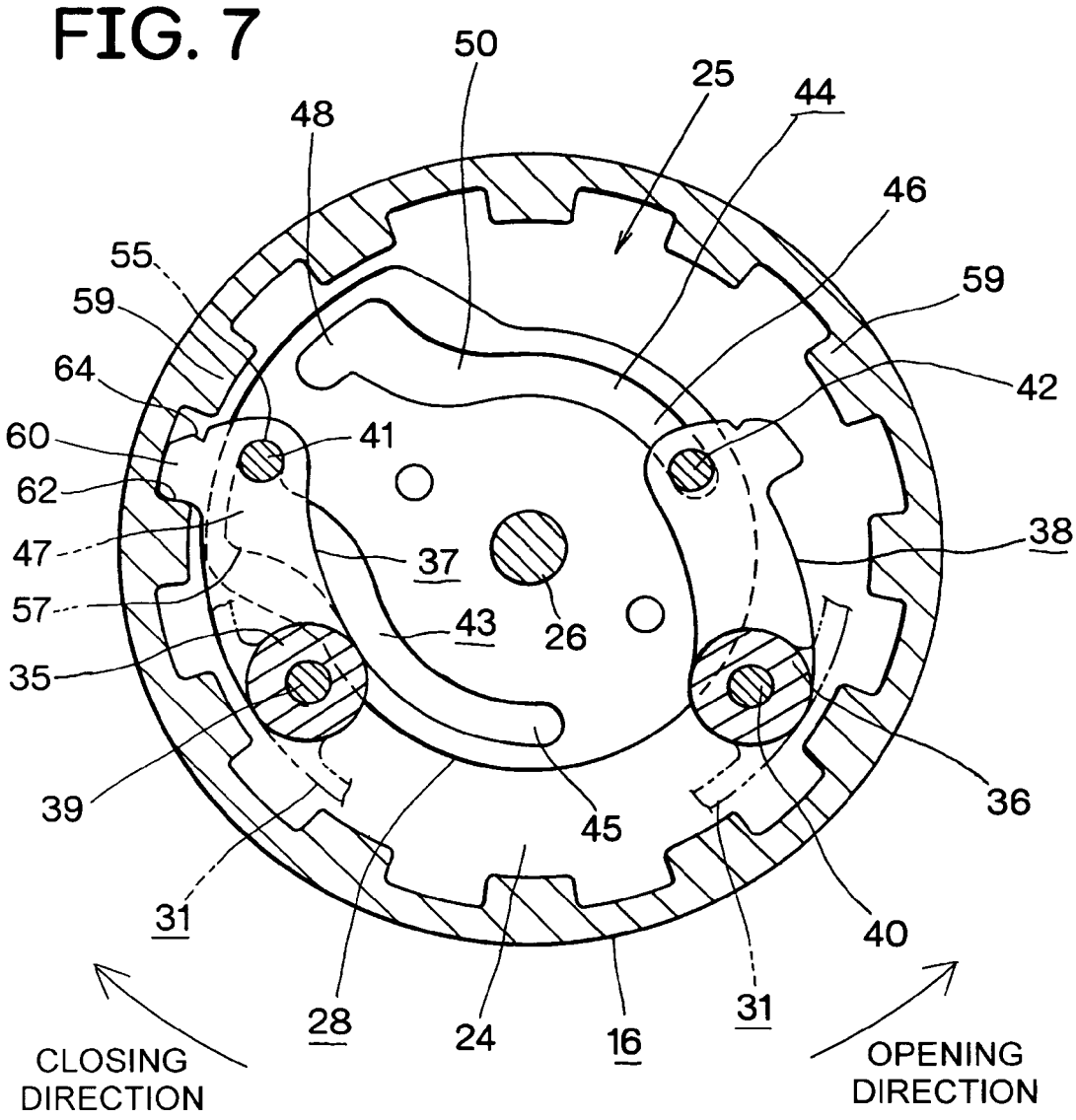
FIG. 7 is a longitudinal sectional view showing a second coupled state of the clutch mechanism.
Figure 8:
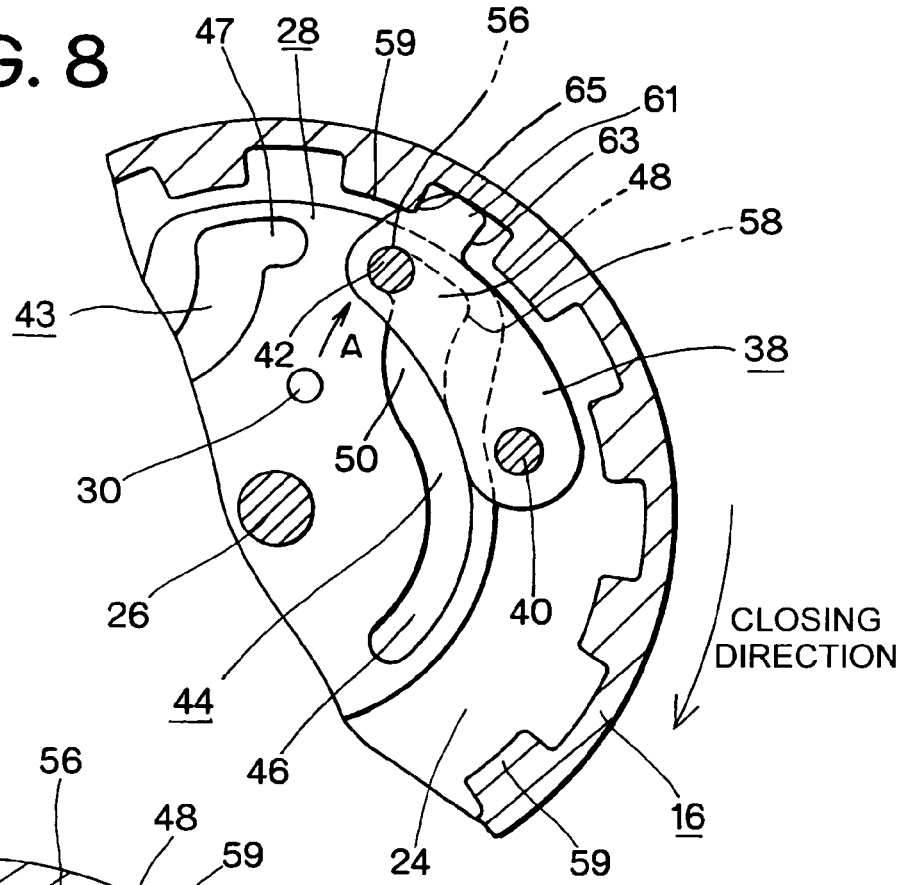
FIG. 8 is a longitudinal sectional view showing a state where a wire drum is rotated in a door-closing direction from the first coupled state shown in FIG. 6.
Figure 9:
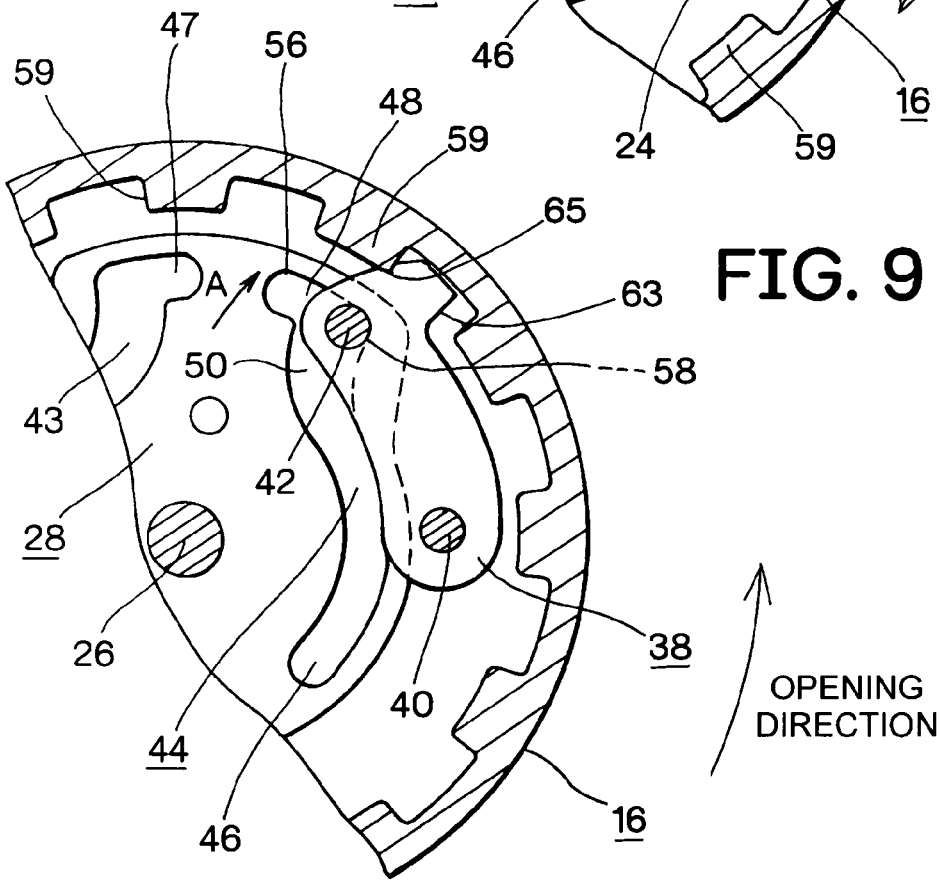
FIG. 9 is a longitudinal sectional view showing a first brake state of the clutch mechanism.
Figure 10:
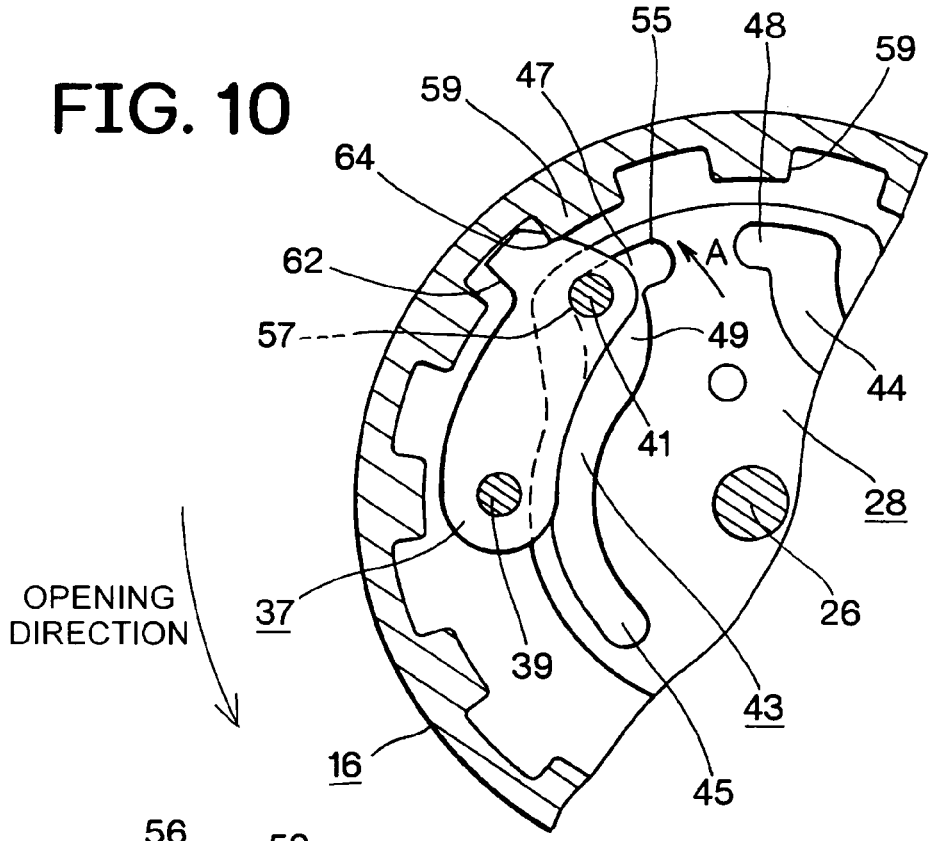
FIG. 10 is a longitudinal sectional view showing a second brake state of the clutch mechanism.
Figure 11:
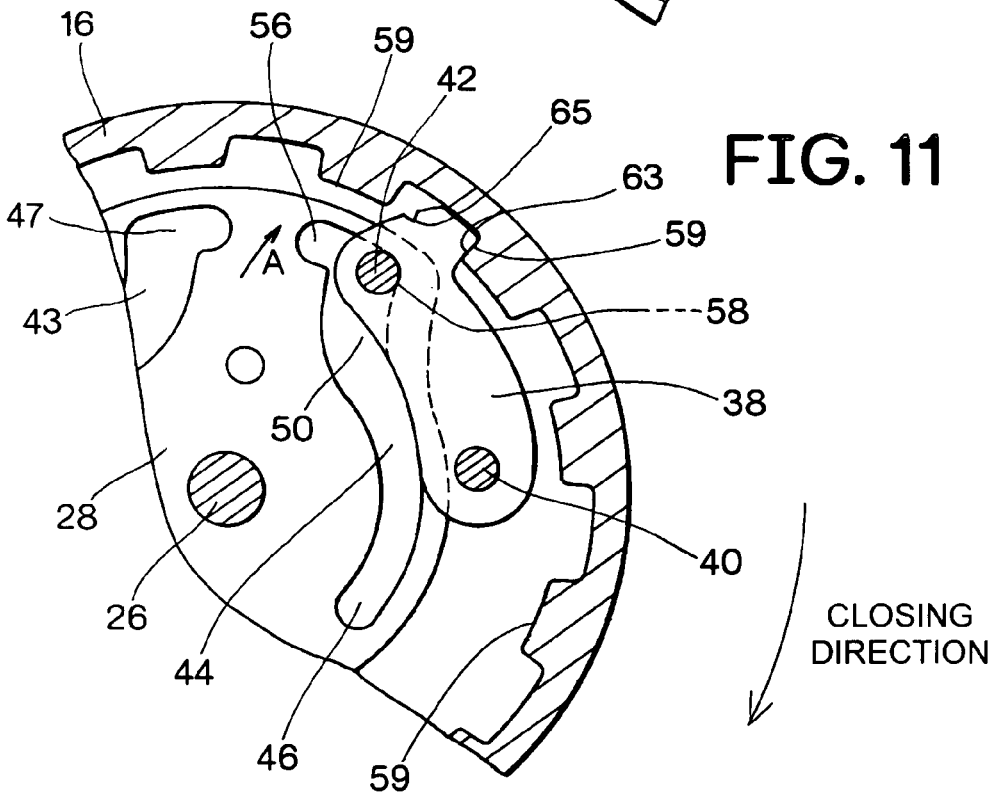
FIG. 11 is a longitudinal sectional view showing a state where the wire drum is rotated in a door-opening direction from the first brake state shown in FIG. 9.

Although the details will be described later, for example, when the motor 14 is rotated in the closing direction, the motor plate 28 rotates clockwise in FIG. 4, while the slide pin 42, as shown in FIG. 6, moves relatively toward the outer slot 48 within the guide slot 44. In this way, the clutch arm 38 is pushed in the direction of the arrow A so as to engage with the wire drum 16. However, since the other slide pin 41 merely moves within the inner slots 45 and is not pushed outside, the other clutch arm is not engaged with the wire drum 16.

On the inner surface of the wire drum 16, plural projections 59 projecting toward the drum shaft 26 are formed at uniform intervals. At the tips of the clutch arms 37, 38, clutch pawls 60, 61 projecting in the direction apart from the drum shaft 26 are respectively formed. One sides of the clutch pawls 60, 61 are respectively formed into coupling faces 62, 63 substantially parallel with the radial direction of the drum shaft 26. On the other sides of the clutch pawls 60, 61, brake dents 64, 65 are respectively formed.

FIG. 13 is a block circuit diagram for performing a control operation in accordance with the present invention. The block circuit has a controller 66, an ammeter or a load detector 67 to measure the electric current flowing through the motor 14, a battery 68 on the vehicle body 13, an operation switch 69, a motor switch 70 and a stop switch 71.

The operation switch 69 has an open position for rotating the motor 14 in the opening direction, a close position for rotating the motor 14 in the closing direction and a neutral position. When the operation switch 69 is pushed, the controller 66 slides the sliding door 11 toward the closed position or the open position by the power of the motor 14.

The motor switch 70 is preferably arranged in the vicinity of a driver seat of the vehicle body 13, and the motor switch 70 has an open position for rotating the motor 14 in the opening direction, a close position for rotating the motor 14 in the closing direction and a neutral position. When the motor switch 70 is operated, the powered sliding device 10 is activated, and when the motor switch 70 is turned off, the powered sliding device 10 is stopped. Accordingly, it is possible to stop the sliding door 11 at a desired semi-open position between a full-closed position and a full-open position by the operation of the motor switch 70. This is convenient in the case that a driver does not wish to open the sliding door 11 widely due to strong wind and/or strong rain.

The stop switch 71 is used in the case of stopping the sliding door 11, which is slid under the control of the controller 66, at the semi-open position.

Since the detailed operations of the clutch mechanism 25 and the auxiliary brake 17 can be understood by referring to Japanese Patent Application Laid-Open No. 2002-201858, U.S. 2002/0088180A1, GB2371333A, DE10164363A1, the description thereof will be omitted in the present application.

Figure 14:
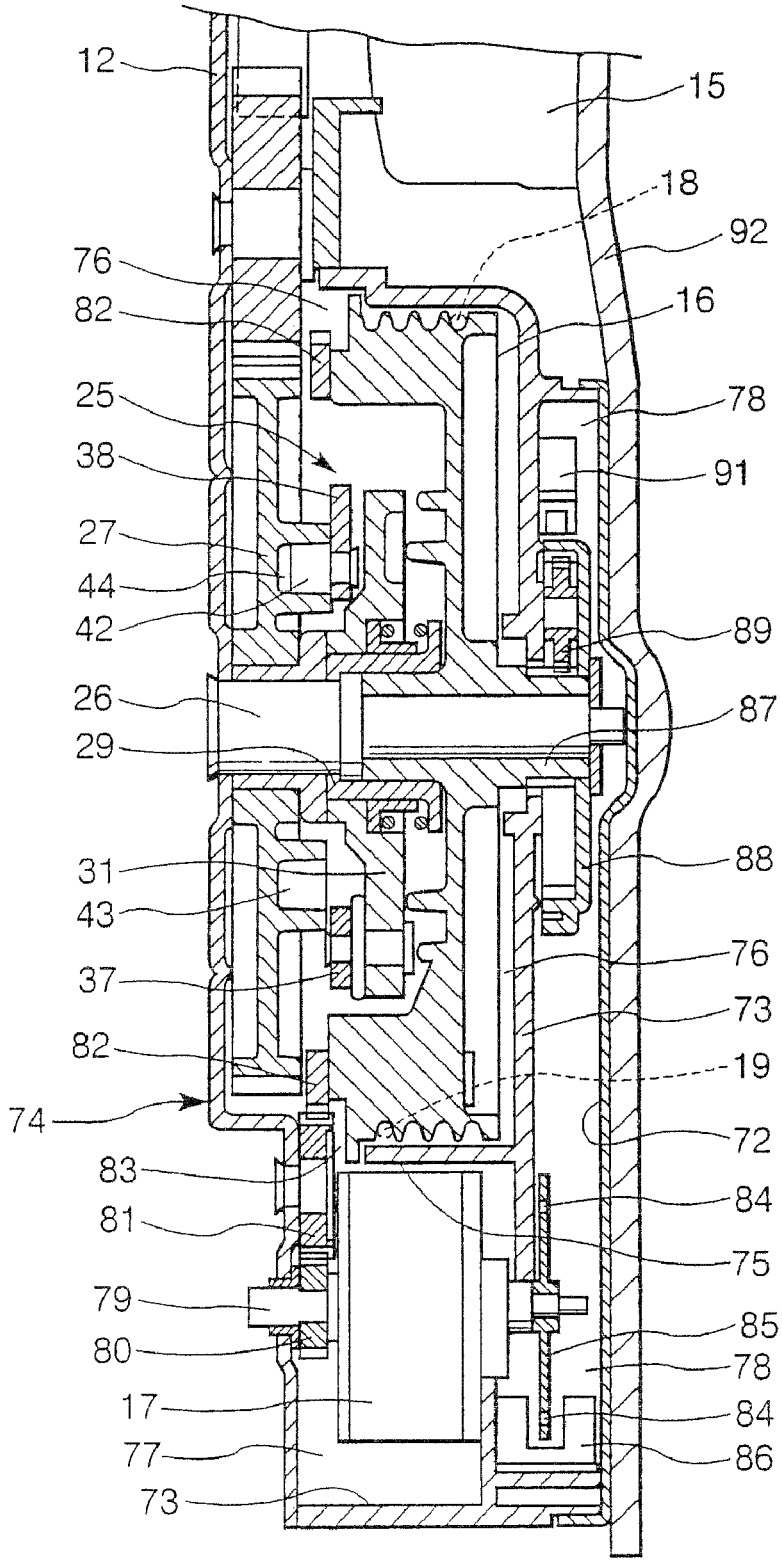
FIG. 14 is a sectional view showing a housing of the sliding device.
Figure 15:
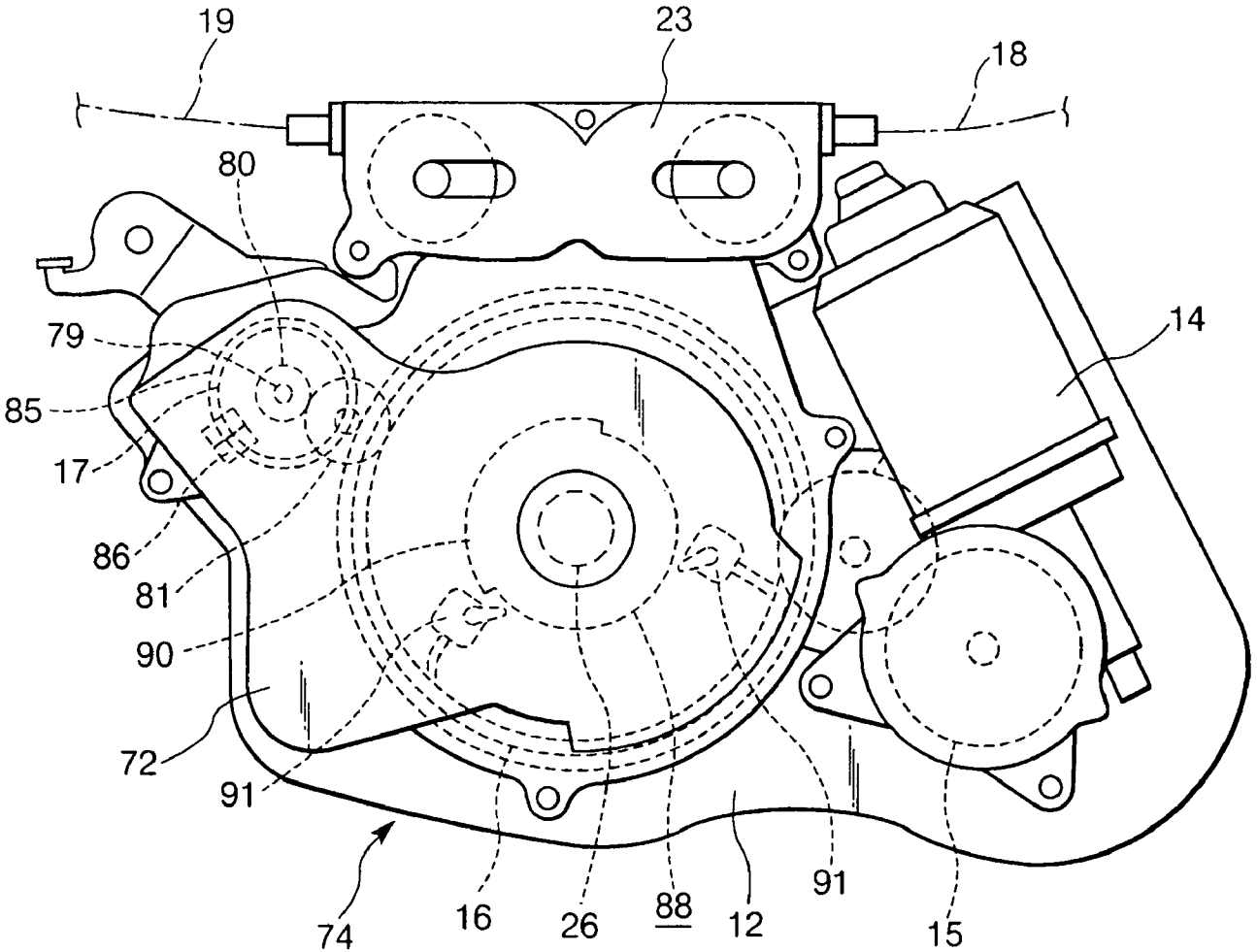
FIG. 15 is a front view showing the housing of the sliding device.

FIG. 14 shows a housing 74 constituted by the metal base plate 12, a metal cover plate 72, and a resin housing body 73 between the plate 12 and the plate 72. The housing body 73 comprises a partition wall 75 extending to the base plate 12. A first space 76 and a third space 77 zoned by the partition wall 75 are formed between the base plate 12 and the body 73. A second space 78 is formed between the cover plate 72 and the body 73.

The auxiliary brake 17 of the powered sliding device 10 is accommodated substantially inside the third space 77. A brake gear 80 fixed to one end of a brake shaft 79 of the auxiliary brake 17 is engaged with a ring gear 82 attached to the wire drum 16 through a coupling gear 81. The coupling gear 81 is disposed in a small communication port 83 between the base plate 12 and the partition wall 75, and the third space 77 is isolated from the first space 76 as far as possible. The brake shaft 79 is always coupled with the wire drum 16 without being affected from the clutch mechanism 25 and is rotated faster than the wire drum 16 when the wire drum 16 is rotated. A rotational resistance is applied to the brake shaft 79 so as to control the rotation of the wire drum 16 when the electromagnetic coil of the auxiliary brake 17 is activated.

The other end of the brake shaft 79 projects inside the second space 78 by crossing over the housing body 73. A disc 85 comprising a number of measuring slits 84 is fixed to the other end of the brake shaft 79. The disc 85 is located inside the second space 78. The rotation of the disc 85 is detected by an photo sensor 86 provided inside the second space 78. The controller 66 can perform an arithmetical operation of a rotational speed, a rotational amount and a rotational direction of the wire drum 16 by a signal from the photo sensor 86.

The wire drum 16, the clutch mechanism 25 and the like of the powered sliding device 10 are accommodated substantially inside the first space 76. A central boss portion 87 of the wire drum 16, in which the drum shaft 25 is inserted, projects inside the second space 78. The boss portion 87 is rotatably attached with cam gear 88. The cam gear 88 receives the rotational movement of the boss portion 87 through planet gears 89, and rotates about 360 degrees when the sliding door 11 moves between the opened position and the closed position. Position switches 91, which detect the position of the cam gear 88 (position of the sliding door) by contacting with alum cam portion 90 of the cam gear 88, are provided in the second space 78. The detection signal from the position switches 91 is used for detecting the full-open position and the full-closed position of the sliding door, and the position of the sliding door 11 under sliding by the motive power of the motor 14 is found by a signal from the photo sensor 86.

The outside of the cover plate 72 is attached with a vibration isolating rubber 92 as desired.

EFFECTS OF THE INVENTION

The first space 76 of the housing 74 is communicated with the outside of the housing 74 through the wire cables 18, 19 which connects the sliding door 11 and the wire drum 16. Hence, when the wire cables 18, 19 move by the rotation of the wire drum 16, dust and water adhered on the wire cables 18, 19 can easily enter the interior of the first space 76. However, in the present invention, since the electrical equipment such as the photo sensor 86, the position switches 91 and the like which have poor dust and water resistance are disposed in the interior of the second space 78 substantially isolated from the first space 76 by the housing body 73, it can be expected that the electrical equipment are kept in a good condition for long.

The electrical equipment disposed in the interior of the second space 78 can receive repairing and maintenance services more easily by removing the cover plate 72.

Two pieces of the members rotated by the rotation of the wire drum 16, that is, the disc 85 and the cum gear 88 are disposed in such a manner as not to be laid one upon another in an axial direction of the drum shaft 26, and the disc 85 rotates about the brake shaft 79, and the cam gear 88 rotates about the drum shaft 26. When disposed in such a manner, the thickness of the sliding device 10 in the axial direction of the drum shaft 26 can be made thin.

The disc 85 attached to the brake shaft 79 rotates faster than the wire drum 16. Hence, a slow rotation or a limited rotation of the wire drum 16 is favorably reflected on the rotation of the disc 85, so that the photo sensor 86 can accurately detect the rotation of the wire drum 16.

The invention claimed is:

1. A device for a sliding vehicle door comprising:

a wire drum (16) connected to a wire cable for sliding the vehicle door (11) by winding and unwinding the wire cable when rotated;

a motor (14) selectively rotating the wire drum (16) mounted on a drum shaft (26);

a clutch mechanism (25) provided between the motor (14) and the wire drum (16);

a first rotational member (85) mounted on a brake shaft (79) simultaneously rotated with the wire drum (16);

wherein said drum shaft (26) and said brake shaft (79) are spaced apart from and are parallel to each other;

a first detector (86) for detecting rotation of the first rotational member (85);

a housing (74);

wherein said housing (74) has a first space (76) accommodating the wire drum (16) and communicating with the outside of the housing (74) and a second space (78) accommodating the first rotational member (85) and the first detector (86);

wherein an interior wall (73) of the housing disposed between the first space (76) and the second space (78) substantially entirely separates the first space from the second space, and an auxiliary brake (17) selectively applying brake resistance to the wire drum (16), wherein said auxiliary brake (17) is mounted on the brake shaft (79) outside of the second space and the brake shaft rotates simultaneously with the wire drum (16), wherein one end of the brake shaft projects into the interior of the second space (78), and the first rotational member (85) is fixed to the one end of the brake shaft in the second space;

wherein said housing has a third space separated from the first space by a partition wall of the housing, communicates with the first space only through a port through the partition wall, wherein said auxiliary brake is accommodated in the third space and wherein said wire drum and said brake shaft are connected with each other by way of transmitting means passing through the port.

2. The device for a sliding vehicle door according to claim 1, further comprising a second rotational member being rotated simultaneously with the wire drum and a second detector for detecting the rotation of the second rotational member, and wherein said second rotational member and said second detector are provided in the interior of the second space.

3. A device for sliding a vehicle door comprising:

a wire drum (16) connected to a wire cable for sliding the vehicle door by winding and unwinding the wire cable when rotated;

a motor (14) selectively rotating the wire drum (16) mounted on a drum shaft (26);

a clutch mechanism (25) provided between the motor and the wire drum;

a rotational member (85) being mounted on a brake shaft (79) and simultaneously rotated with the wire drum;

wherein said drum shaft (26) and said brake shaft (79) are spaced apart from and are parallel to each other;

a detection means (86) for detecting rotation of the rotational member;

an auxiliary brake (17) selectively applying a brake resistance to the wire drum;

a housing (74);

wherein said housing has a base plate (12), a cover plate (72) and a housing body (73) located between the base plate and cover plate;

wherein a first space (76) is formed between the base plate and the housing body, and a second space (78) isolated from the first space is formed between the cover plate and the housing body;

wherein a third space (77) is formed between the base plate and the housing body, the third space (77) being separated from the first space a partition wall (75) and communicates with the first space only through a communication port in said partition wall;

wherein said wire drum is disposed in the first space, and said rotational member and the detection means are disposed in the second space, and said auxiliary brake is disposed in the third space;

wherein said auxiliary brake and said wire drum are connected with each other by way of a transmitting means passing through the communication port, and wherein the auxiliary brake is mounted on the brake shaft outside of the second space and the brake shaft rotates simultaneously with the wire drum;

wherein one end of the brake shaft projects into the interior of the second space and the rotational member is fixed to the one end of the brake shaft.

* * * * *